US005494231A

United States Patent [19]

Hermanns

[11] Patent Number: 5,494,231

[45] Date of Patent: Feb. 27, 1996

[54] METHOD AND APPARATUS FOR FINDING AND FEEDING A YARN END TO BE TAKEN UP IN A TEXTILE WINDER

[75] Inventor: Ferdinand-Josef Hermanns, Erkelenz, Germany

[73] Assignee: W. Schlafhorst AG & Co., Moenchengladbach, Germany

[21] Appl. No.: 166,919

[22] Filed: Dec. 13, 1993

[30] Foreign Application Priority Data

Dec. 12, 1992 [DE] Germany ..... 42 41 992.1

[51] Int. Cl.[6] ..... B65H 54/00; B65H 67/06

[52] U.S. Cl. ..... 242/35.6 R; 242/35.5 R; 242/35.6 E

[58] Field of Search ..... 242/35.6 R, 35.6 E, 242/35.5 R

[56] References Cited

U.S. PATENT DOCUMENTS

| | | | |
|---|---|---|---|
| 3,111,280 | 11/1963 | Reiners et al. | 242/35.5 |
| 4,664,326 | 5/1987 | Grecksch et al. | 242/35.6 R X |
| 4,801,108 | 1/1989 | Grecksch et al. | 242/35.5 A |
| 4,943,009 | 7/1990 | Gerstner-Stevens et al. | 242/35.6 E |
| 5,082,194 | 1/1994 | Grecksch et al. | 242/35.6 R |
| 5,282,581 | 2/1994 | Engelhardt et al. | 242/35.6 E |

FOREIGN PATENT DOCUMENTS

| | | | |
|---|---|---|---|
| 3733353A1 | 12/1988 | Germany . | |
| 1025756 | 4/1966 | United Kingdom | 242/35.6 E |

*Primary Examiner*—William Stryjewski
*Attorney, Agent, or Firm*—Shefte, Pinckney & Sawyer

[57] ABSTRACT

A method and apparatus for finding and feeding a yarn end to be taken up in a textile winder in which bobbins in an upright disposition on individual tube support members are advanced sequentially to a winding position. A detector determines whether yarn is being unwound from the bobbin the winding position. If the detector detects that no yarn is being unwound, a yarn finding device locates with suction the yarn end on the bobbin in the ready position next succeeding the bobbin in the winding position. The finding of the yarn end is assisted by an air blowing device. A yarn feeding device feeds the yarn end to a yarn joiner to be joined to the trailing yarn end from a take-up yarn package, or places the yarn end on an empty take-up package tube. The yarn finding device employs an open end yarn end receiving portion, which applies suction to the upstanding end of the bobbin in the ready position. The yarn end receiving end portion is adjustable to accommodate bobbins of different lengths and has a slot through which the found yarn passes to feed to the take-up as the bobbin moves to the winding position. A balloon breaker has mounting positions extending from the yarn end receiving end portion on opposite sides of the slot to guide the yarn into the balloon breaker above the winding position.

20 Claims, 7 Drawing Sheets

METHOD AND APPARATUS FOR FINDING AND FEEDING A YARN END TO BE TAKEN UP IN A TEXTILE WINDER

FIELD OF THE INVENTION

The invention relates to a method and apparatus for feeding a yarn end from a bobbin to be taken up in a textile winder in which bobbins are advanced sequentially to a winding position in upright disposition on individual tube support members.

BACKGROUND OF THE INVENTION

Textile yarn winders are generally used to rewind or wind yarn, furnished in the form of bobbins from a ring spinning machine or another spinning device, to make conical or cylindrical cross-wound yarn packages. Generally, yarn from several bobbins is wound onto a single yarn package. Automatic textile yarn winders must therefore be furnished with some arrangement whereby a yarn bobbin can be unwound and then succeeded in the winding position by another bobbin or bobbins. When a new yarn bobbin replaces an empty one, the starting yarn end of the new bobbin must be located, so that it can be joined to the trailing end of the yarn on the take-up yarn package. The same problem arises if a new yarn bobbin moves into the winding position for any other reason, for example, if yarn breaks during the unwinding of a yarn bobbin and the yarn end cannot be located, in which case a new bobbin also must be advanced.

Previous known constructions in which upright individual tube support members were employed operated to find a yarn end on the yarn bobbin first when the yarn bobbin moved into the winding position. This approach is illustrated by U.S. Pat. No. 5,082,194. This arrangement concentrated a number of operations at the winding position, resulting in a complex and time consuming arrangement of mechanical parts.

Another approach, as illustrated in U.S. Pat. No. 3,111,280, required that yarn bobbins be delivered to the textile winder in a horizontal disposition. This prevented the use of upright individual tube supports for the yarn bobbins, which allow yarn bobbins to be transported without the yarn resting upon supporting surfaces. Furthermore, this method employed a complicated mechanical arrangement in feeding the yarn from the yarn bobbin to be taken up.

SUMMARY OF THE INVENTION

It is accordingly an object of the present invention to provide an improved method for finding and feeding a yarn end from a bobbin to be taken up in a textile winder.

According to the method and apparatus of the present invention, this object is achieved by finding a yarn end on the bobbin while the bobbin is in the ready position next succeeding the bobbin at the winding position, and then feeding the found yarn end so that it can be taken up when the next succeeding bobbin advances to the winding position. The yarn end will be found on the next succeeding bobbin whenever it has been detected that the bobbin in the winding position has run empty or that a yarn has broken in the winding position and the yarn end cannot be found. The present invention is advantageous because it offers an improved arrangement of the components of a textile winder and it allows yarn bobbins to be advanced sequentially to the winding position while situated on upright individual tube support members.

It is advantageous to employ a suction tube as the yarn end finding device of the present invention. The suction tube is provided so that it will apply suction to the yarn on the upstanding end of the bobbin succeeding the bobbin in the winding position.

The present invention also contemplates the provision of an air blowing device in the yarn end finding device for the purpose of blowing air against the yarn on the upstanding end of the yarn bobbin to loosen an end of the yarn. The air blowing device blows the starting end of the yarn away from the end of the bobbin and thereby reinforces the action of the suction in drawing away the yarn end.

In order to coordinate the operations of the textile winder, it is advantageous to feed the found yarn end to be taken up on the yarn take-up package while the bobbin is advanced to the winding position. This arrangement is efficient and saves time.

In the event that a yarn end cannot be found on the bobbin in the ready position, it is advantageous to sense the failure to find a yarn end and to advance the bobbin in the ready position through the winding position to be expelled. This prevents the winding station from being blocked by a defective yarn bobbin.

The present invention also contemplates that a number of attempts to find a yarn end will be performed on the bobbin succeeding the bobbin in the winding position. Only after a number of sensings of no yarn end being found will the bobbin be advanced through the winding position and expelled.

Also according to the present invention, the suction tube on the yarn finding device has an open yarn end receiving end portion, which is located adjacent the bobbin in the ready position. The open yarn and receiving end portion allows suction to be concentrated on the upstanding end of the bobbin in the readying position.

It is advantageous if the suction tube of the yarn end finding device has a movable portion for feeding the found yarn end to be taken up. The found yarn end can thereby be positioned so that it can be taken up on the take-up yarn package without adding complex additional components. It is also possible to provide a vertical slit throughout the longitudinal extent of the stationary portion of the suction tube. The slit allows the yarn end to move out of the stationary portion of the suction tube when it is carried upward by the movable portion of the suction tube. It is advantageous if the movable portion of the suction tube pivots for rotation toward the winding position for feeding the yarn end to be taken up.

The present invention also contemplates that the open yarn end receiving end portion straddles the upright end of the bobbin in the readying position. Bobbins are thereby allowed to advance through the readying position without being obstructed by the stationary open yarn and receiving end portion. The open yarn and receiving end portion may also be adjustable to accommodate differing bobbin lengths.

In the preferred embodiment, a balloon breaker is provided in the winding position. The balloon breaker may have a pair of mounting portions which can be secured to the open end yarn end receiving end portion on opposite sides of the vertical slit. The yarn end is thereby guided from the slit in the suction tube into the balloon breaker.

Also, the suction tube may be provided with a baffle plate clamping device, which can clamp a yarn end drawn into the suction tube, thereby also cutting off suction below the baffle plate and reducing the use of suction.

The invention will be described in further detail below in terms of an exemplary embodiment of a yarn end feeder.

DETAILED DESCRIPTION OF THE PREFERRED EMBODIMENT

Figure 1:
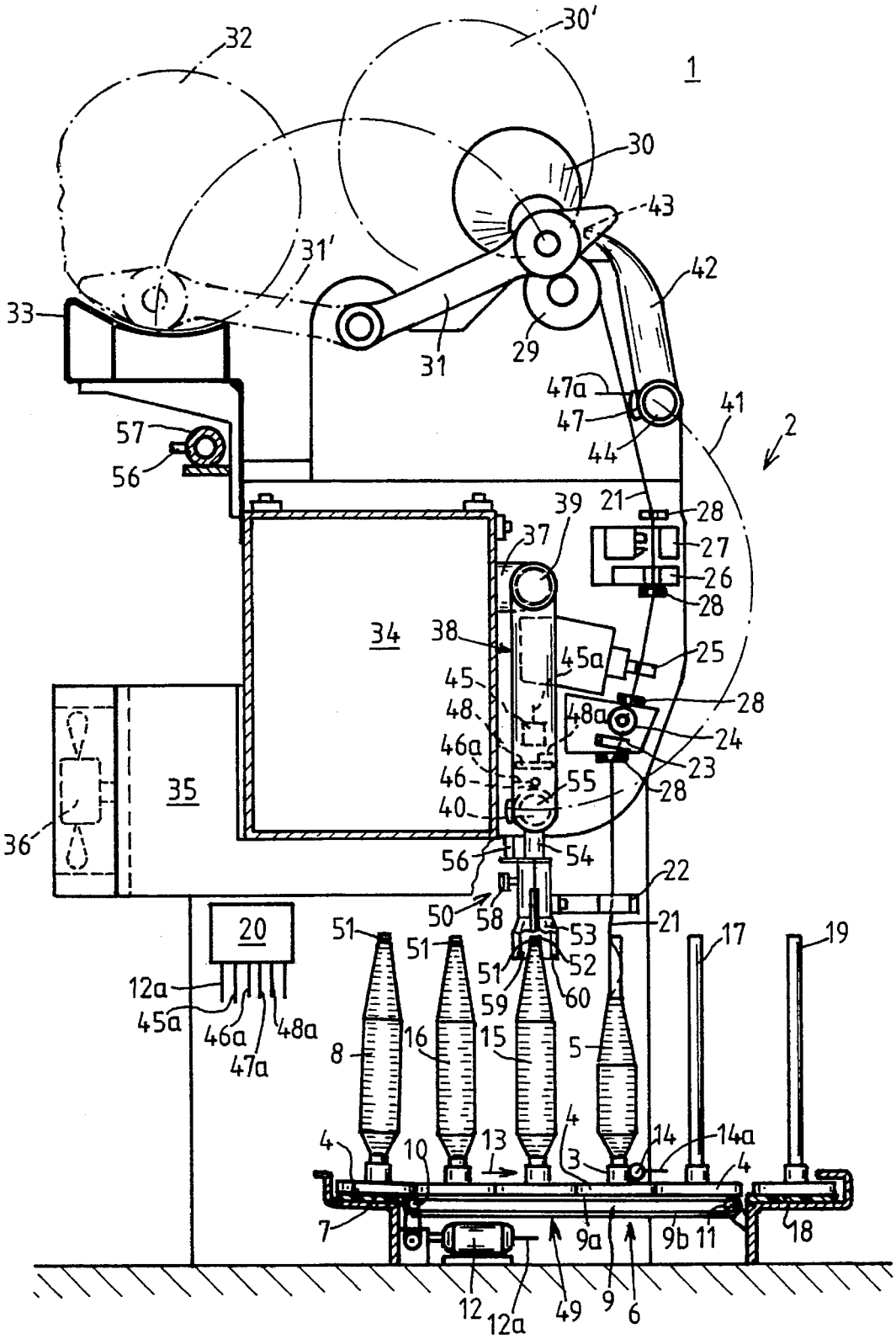
FIG. 1 is an elevational view partially in section of a winding station of a textile winder incorporating the apparatus of the present invention.

In FIG. 1, a winding station 2 of a textile winding machine 1 is illustrated, it being understood that the textile winding machine 1 includes a plurality of identically configured winding stations (not shown). The winding stations of the textile winding machine 1 are arranged in a row in a direction transverse to the plane of FIG. 1. Each winding station 2 is operable to wind yarn from a supply bobbin onto a take-up yarn package and each winding station incorporates the apparatus of the present invention for feeding a yarn end from a supply bobbin to be taken up in a textile winder.

The textile winding machine i receives supply packages from a textile spinning machine (not shown) which includes spinning stations. The spinning stations repetitively perform a yarn building operation in which yarn is built onto an empty tube individually supported in an upright disposition on a tube support member 4 to form a yarn package 8,16. The tube support members 4 are of the type having a cylindrical base portion, on top of which are mounted a relatively smaller diameter cylindrical neck portion and a vertical post 3. The yarn packages 8,16 are then transported, with the tubes still in an upright disposition, on the tube support members 4 to a supply location at one end of the textile spinning machine for supplying of the yarn packages to the textile winding machine 1.

The winding station 2 includes a frame on which is mounted a take-up package support arm 31 for supporting a take-up package 30 thereon. A package delivery assembly includes an endless belt 7 extending from a package supply location (not shown) along one side of the winding stations 1.

A cross-transport assembly includes an endless belt 9 trained around a pair of rollers 10,11. The upper run of the endless belt 9*a* travels in the direction shown by an arrow 13 in FIG. 1 and the lower run of the endless belt 9*b* moves in the opposite direction. The upper run of the endless belt 9*a* travels through a winding position 6 adjacent the winding station 2 at which a supply yarn bobbin 5 is supported during winding of yarn therefrom at the winding station. The supply yarn bobbin 5 is held in place at the winding position 6 during the winding process by a device 14, not shown in further detail here.

The endless belt 7 of the package delivery assembly extends adjacent a respective end of the endless belt 9 and is operable to transport the tube support members 4, with the yarn packages 8 supported in upright dispositions thereon to the respective adjacent end of the endless belt 9 for engagement by the endless belt to effect transfer of the tube support members 4 from the endless belt 7 of the package delivery assembly to the endless belt 9 of the cross-transport assembly. The endless belt 9 transports the tube support members 4 in the direction shown by the arrow 13 to the winding position 6 and, after winding of the yarn bobbin supported on a respective tube support member 4, the respective tube support member, which now supports an empty tube 17 thereon, is further transported by the endless belt 9 to a tube discharge assembly having an endless belt 18 positioned adjacent the other end of the endless belt 9.

The endless belt 18 extends along the winding stations on the opposite sides thereof with respect to the side along which the endless belt 7 of the package delivery assembly extends and is operable to transport the tube support members 4 having empty tubes 19 supported thereon to a tube transfer location (not shown).

Endless belt 9 is driven by drive mechanism 12, while endless belts 7 and 18 are driven by other drive mechanisms (not shown). Drive mechanism 12 of endless belt 9 is connected via a signal line 12*a* to a control unit 20 in the form, for example, of a conventional computer for controlling the various operations of the winding station 2.

During a winding operation, a yarn 21 is drawn from the supply bobbin 5 located in the winding position 6. A balloon breaker 22 is disposed above the supply bobbin 5. The yarn 21 travels through a yarn preclearer 23 and a yarn tensioner 24, and then through a yarn joiner 25. From there, the yarn travels past an electronic yarn clearer 26, in which yarn flaws are detected, and a cutting and clamping device 27, which is disposed above the electronic yarn clearer 26. The cutting and clamping device 27 is operatively connected with the electronic yarn clearer 26. The yarn 21 is guided along its path by yarn guides 28. A traversing feed drum 29 is mounted relative to the travel path of the yarn for feeding the yarn in a traversing manner onto the cross-wound take-up package 30. The take-up package 30 is held by the take-up package support arm 31 and rests with its circumference on the traversing feed drum 29. The traversing feed drum 29 also drives the take-up package 30.

Dot-dash lines indicate the outline of a full take-up bobbin 30'. For setting down a full take-up bobbin, the take-up package support arm 31 can be pivoted to a position 31', shown in dot-dash lines. The contour of a full take-up bobbin 32, shown after it has been set down on a transport device 33, is also represented by dot-dash lines. The transport device 33 is disposed on the back of the bobbin winding machine 1 and extends along the winding stations 2.

The devices which make up the winding station 2 are disposed around a central suction plenum 34, which extends longitudinally through the bobbin winding machine 1. The end of the suction plenum opens into an expulsion chamber 35, which is disposed at the end of the bobbin winder 1 and in which dust and yarn residues are expelled. A fan 36 shown in dashed lines operates as a negative pressure source for the central section conduit 34 and the explosion chamber 35. The apparatus, to the extent described so far, is conventional.

A suction tube 38 is connected to the central section plenum 34 by a connecting tube 37. The suction tube 38 is rotatably supported at the connection 39 around the connecting tube 37. On its other end, the suction tube 38 has a suction nozzle 40, whose opening extends outward at a right angle relative to the plane of yarn travel. In the present exemplary embodiment, the suction tube 38 performs the functions that otherwise two separate suction tubes, as known from the prior art, would carry out. Constrictions of this type from the known prior art involve a yarn collecting suction tube, which locates the yarn end from the supply bobbin and places it in a yarn joiner and a further suction tube which locates the trailing yarn end from the take-up yarn package and places it also in a yarn joiner.

Figure 5:
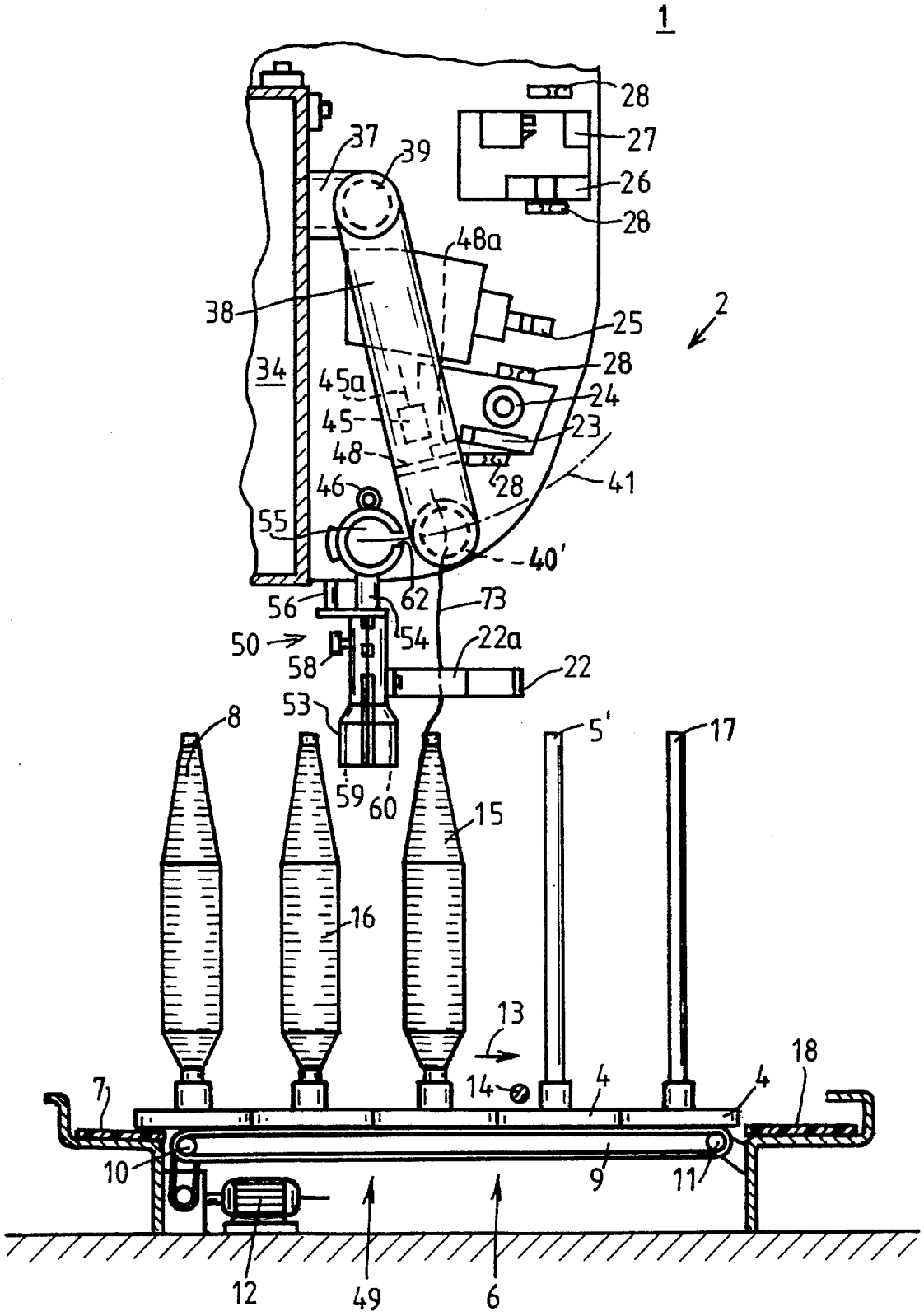
FIGS. 5 and 6 are views similar to FIG. 1 showing the progressive movement of the suction tube and the bobbins in the winding station.
Figure 6:
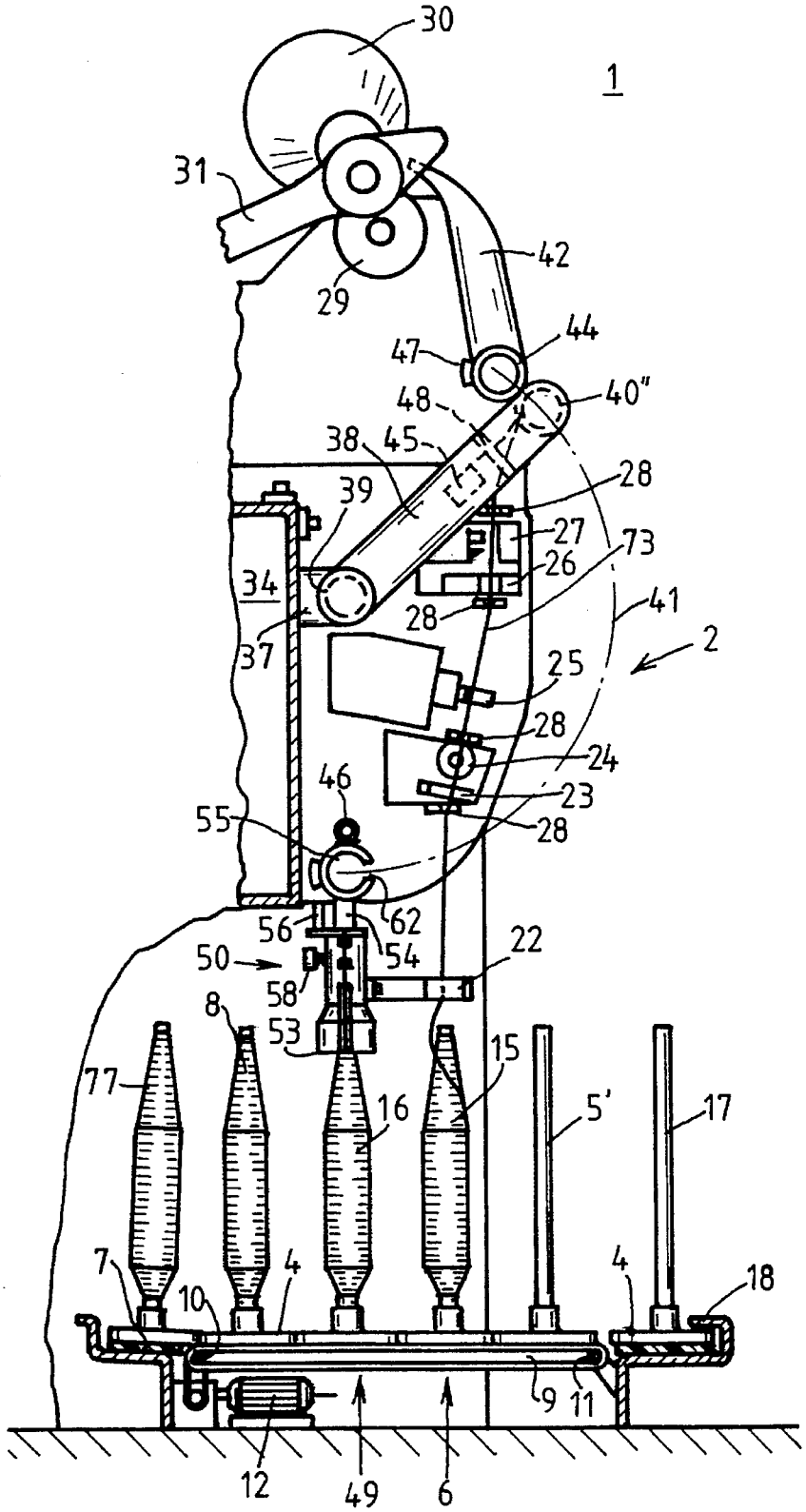

Following a yarn break, in the present exemplary embodiment, the yarn end finding device 50 operates through the suction tube 38 to locate the lower yarn end running from the supply bobbin to the yarn tensioner 24. Once the lower yarn end has been located, the yarn end feeding device, also operating through the suction tube 38 places the yarn end in the yarn joiner 25. Following a change of supply bobbins, the suction tube 38 locates the yarn end of the new supply bobbin and places it as a lower yarn in the yarn joiner 25. In performing this function, the suction nozzle 40 of the suction tube 38 travels in an arc-shaped path 41 (see FIGS. 5 and 6).

A stationary tube 42 is disposed in the upper part of the winding station tube. The upper portion of the stationery tube 42 ends in a flat nozzle 43, opposite the surface of the take-up yarn package 30. The lower portion of the stationary tube 42 ends in a circular opening 44.

Once the lower yarn end has been located on the supply bobbin and placed in the yarn joiner 25, the suction nozzle 40 of the suction tube 38 is pivoted upward until it reaches the opening 44 on the stationary tube 42. Suction is then applied through the stationary tube 42 in order to locate the trailing end on the take-up yarn package and pulls it through the flat nozzle 43. A sensor 45 is mounted in the suction tube 38, by means of which the presence of a found yarn end in the suction tube can be detected and reported to the control device 20 via the signal line 45*a*. As a function of the detection of the found yarn end by the sensor 45, the motions of the suction tube 38 can be controlled. The conventional drive mechanism of the suction tube 38 is not illustrated. The positioning of the suction tube 38 can be accomplished through sensors 46 and 47, which report the position of the suction tube 38 to the control device 40 via signal lines 46*a* and 47*a*. A baffle plate clamping device 48 is also provided for closing the suction tube 38 and for clamping a found yarn end in the suction tube. The baffle plate clamping device 48 is closed when a yarn end is drawn in by the suction tube 38 and its presence is reported by the sensor 45 to the control device 20.

Once the yarn on the supply bobbin 5 in the winding position 6 has been completely unwound, only an empty tube remains on the tube support member 4. The supply bobbin 15 located in the ready position 49 must be advanced to the winding position 6. In order to continue the winding process, the yarn end on the supply bobbin 15 must be located and joined to the trailing end of the take up yarn package 30. The present invention provides a yarn end finding device 50 located above the ready position 49. Each of the supply bobbins which will be delivered to the winding position, in FIG. 1 supply bobbins 8, 15, and 16, each have a top winding 51 which is a reserve winding of yarn under tube tips 52. This top winding is loosened with the aid of the yarn end finding device 50 so that it may be pulled into the suction tube 38, which then feeds the yarn end into the yarn joiner or places it against an empty yarn take-up package tube.

The supply bobbin 15 stands in the ready position 49, with its tube tip 52 located below the open yarn end receiving end portion 53, which is attached to a tubular connection piece 54, which ends in an opening 55 oriented so that it can communicate with the suction nozzle 40 of the movable suction tube 38. The end portion 53, the tubular connection piece 54, and the opening 55 make up the stationary portion of the suction tube. Once the movable suction tube 38 is positioned so that it communicates with the opening 55 of the tubular connection piece 54, negative pressure applied through the suction nozzle 40 will loosen the yarn end on the tube tip 52 of the supply bobbin 15 located in the ready position 49.

The loosening of the yarn end from the supply bobbin 15 is assisted by an air blowing device for blowing air onto the yarn on the upstanding end of the supply bobbin 15. Compressed air for the air blowing device is delivered through the line 56, which extends from a central compressed air source (not shown), via the line 57 to the individual winding stations of the textile winding machine 1.

The end portion 53 may be adjustable in height, by use of a clamping screw 58 to accommodate different lengths of bobbins. The balloon breaker 22 is disposed above the winding position 6, and surrounds the yarn 21 drawn from the delivery bobbin 5 located in the winding position 6.

Figure 2:
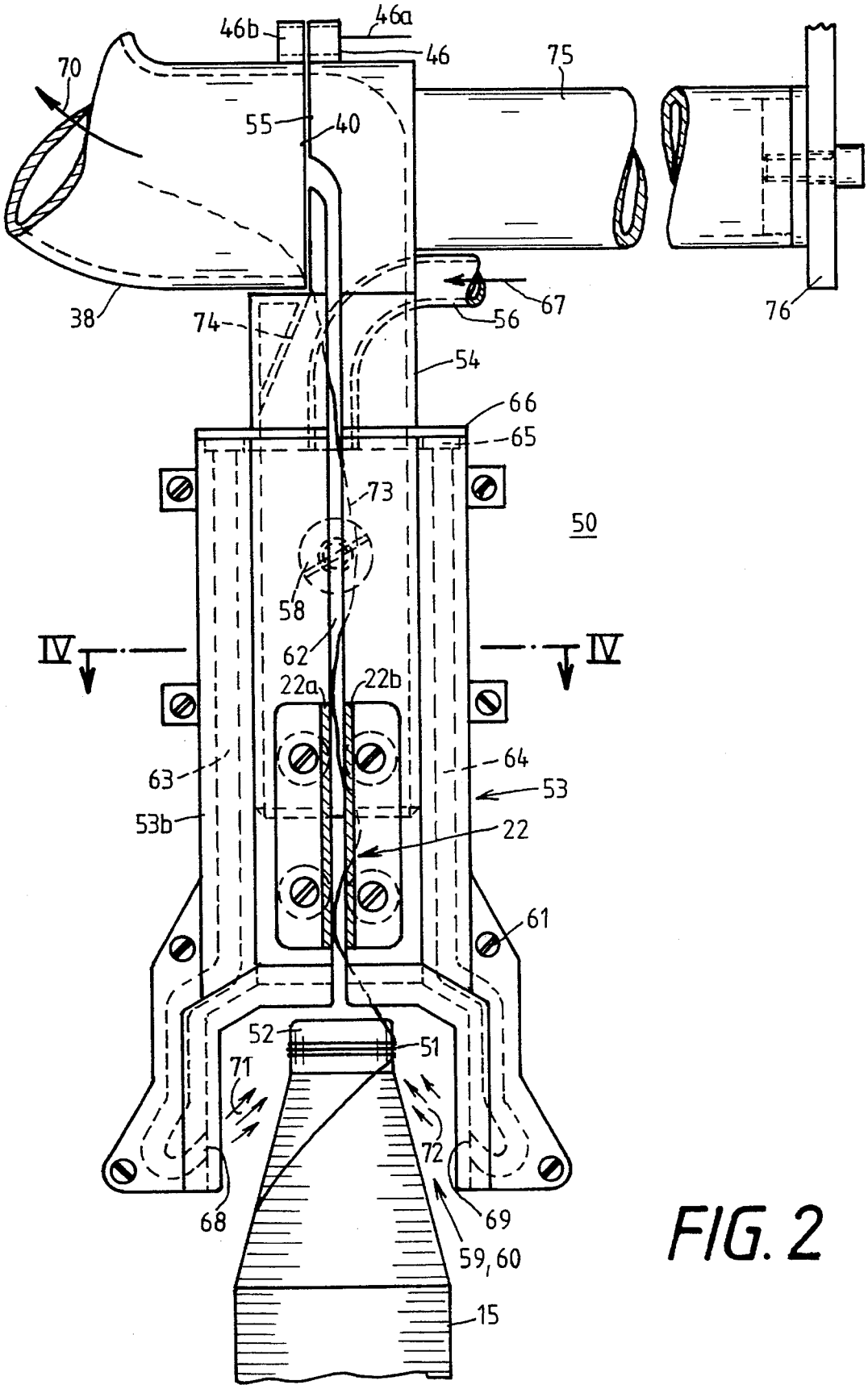
FIG. 2 is an enlarged partial elevational view of the suction tube components of the apparatus of FIG. 2.

FIG. 2 shows the yarn end finding device 50 in detail. The supply bobbin 15, in the ready position 49, has its upstanding 52 located below the yarn end receiving end portion 53. This end portion 53 has two openings 59 and 60 which are located opposite one another, and are oriented along the direction 13 in which the conveyor belt 9 moves, thereby resulting in an arrangement where the end portion 53 straddles the upright supply bobbin 15 in the ready position 49, and permits supply bobbins to advance through the ready position 49 without obstruction. Accordingly, a supply bobbin transported to the ready position. 49 passes through the opening 59 into the yarn end receiving end portion 53, and then passes out of the end portion 53 through the opening 60 upon transfer to the winding position 6.

Figure 3:
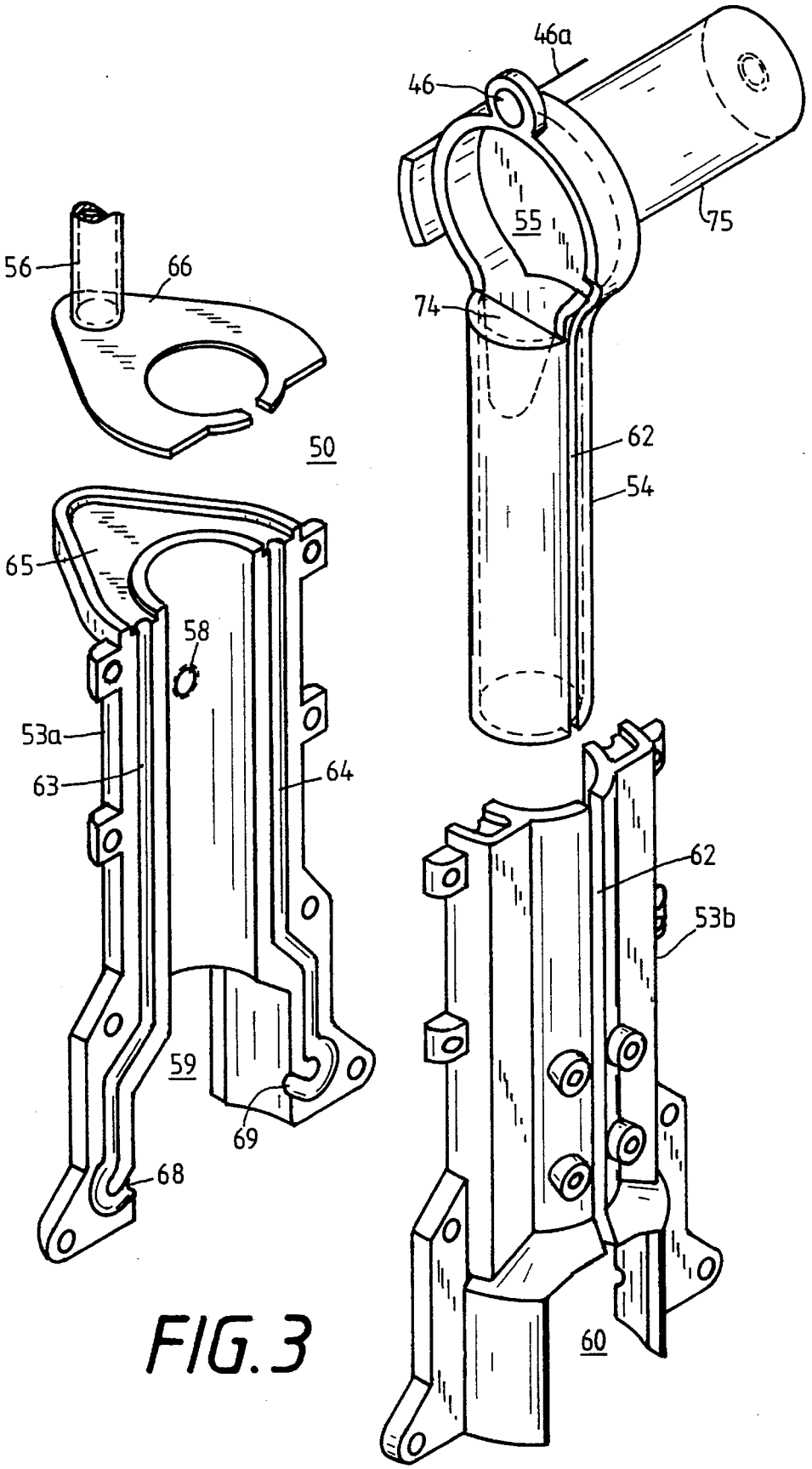
FIG. 3 is an exploded isometric view of the components of FIG. 2.

The yarn end receiving end portion 53 comprises two halves 53*a*,53*b* as can be seen from FIG. 3. The two halves 53*a*,53*b* are fastened together with screws 61. The half 53*b*, which carries the balloon breaker 22, can be seen in FIG. 2 in a frontal view. On the side of the yarn end finding device 50 which faces the winding position 6, both the yarn end receiving end portion 53 and the tubular connection piece 54 have a vertical slit 62 through which the found yarn end passes once the supply bobbin has been moved from the ready position 49 into the winding position 6. Secured to the yarn end receiving portion opposite sides of the slit 62 are mounting portions 22*a*,22*b* of the balloon breaker 22. The mounting portions 22*a*,22*b* comprise two metal plates parallel to one another, which form a passage from the yarn end receiving end portion 53 to the winding position 6, where these plates are shaped into a generally circular balloon breaker 22 which surrounds the yarn 21 as it is wound.

As noted above, the yarn end receiving end portion 53 can be adjusted heightwise in telescoping fashion on the tubular connection piece 54. The yarn end portion 53 is secured on the tubular connection piece 54 by a clamping screw 58. Markings (not shown) may be provided on the tubular connection piece 54 in order to allow quick adjustment of the end portion 53 to accommodate selected bobbin lengths.

As seen in FIG. 3, grooves 63,64 are milled into the face ends of the two halves 52*a*,52*b* of the yarn end receiving end portion 53. These grooves 63,64 form compressed air supply lines when the yarn end receiving end portion 53 is assembled. The compressed air supply line 56 opens into a distribution chamber 65 at the upper end of the yarn end receiving end portion 53. The distribution chamber 65 is closed with a lid 66 to which the tubular compressed air supply line 56 is secured. Compressed air is supplied through the compressed air supply line 56 as indicated by the arrow 67 (shown in FIG. 2). Compressed air supply lines 63,64 discharge into two blower nozzles 68,69. Blower nozzles 68,69 face one another and are located each approximately halfway between the openings 59,60 on opposing sides of the yarn end receiving end portion 53. Blower nozzles 68,69 are oriented obliquely upward toward the upstanding end 52 of the supply bobbin 15 in the ready position 49.

Once the supply bobbin 5 in the winding position 6 has been completely unwound, the detector for detecting the absence of yarn being unwound through the electronic yarn clearer 26 no longer detects any yarn in the yarn path. The suction tube 38 then moves into position to eliminate a possible yarn break. Accordingly, the suction tube 38 pivots into a position in which the suction nozzle 40 can apply suction to any yarn end extending between the yarn tensioner 24 and the supply bobbin 5. If a yarn end is not initially drawn into the suction tube 38, the suction tube 38 can be pivoted downward in a plurality of attempts to find a yarn end. If the sensor 45 does not detect any yarn being pulled in by the suction tube 38 after a predetermined number of attempts, a change of supply bobbins is then initiated. The suction tube then pivots back to its original position wherein the suction nozzle 40 communicates with the opening 55, and suction is turned on in that position.

The suction is turned on when the sensor 46 senses the reflection marking **46*b* on the suction tube 38. In this orientation, the suction nozzle 40 of the suction tube 38 is located precisely opposite the opening 55 of the tubular connection piece 54 attached to the yarn end receiving end portion 53. Simultaneously with the application of suction at the suction tube 38, as shown by the arrow 70, compressed air 67 is blown into the end portion 53 through the compressed air line 56. Compressed air then emerges from the outlet openings 68,69 as representing by the arrows 71,72, respectively. The joint action of air blown into the end portion and the negative pressure applied through the suction tube 38 loosens the yarn end on the upstanding tube end 52, and yarn end 73 of the yarn from the supply bobbin 15 is pulled into the suction tube 38**.

The yarn end 73 is detected by the sensor 45 in the suction tube 38, and this information is passed through the control device 20 via the signal line **45*a*. The baffle plate clamping device 48 is closed to cut off suction and to clamp the yarn end 73. The opening 55 is constructed to enable unproblematic transfer of the yarn end 73 into the suction tube 78. To this end, plate 74 is placed in the tubular connection piece 54 at the opening 55 to create a smooth passage into the opening 55. The yarn end finding device 50 is secured to the machine frame 72 of the textile winding machine 1 with a mount 75**.

Figure 4:
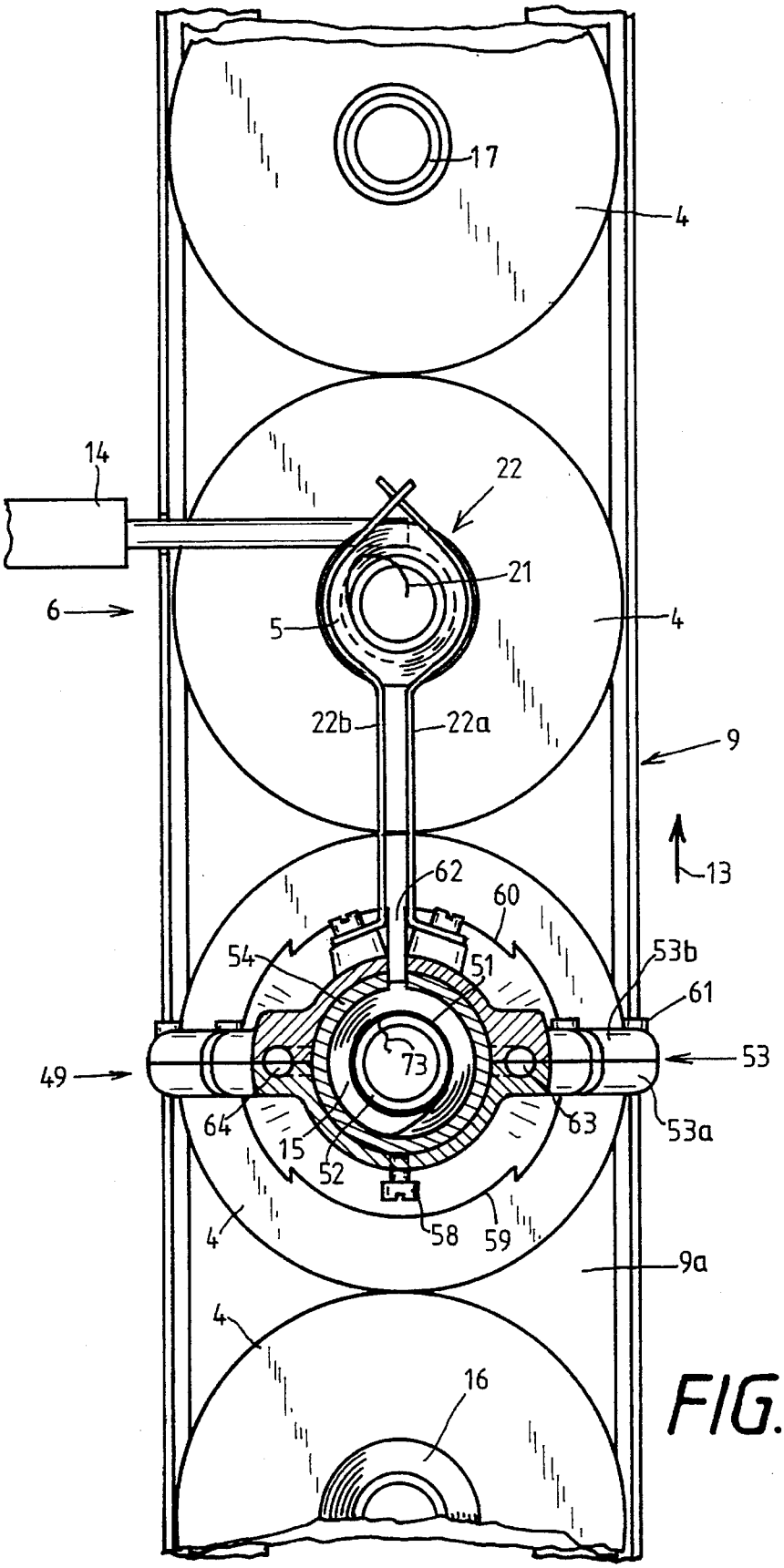
FIG. 4 is a horizontal sectional view of the winding position and readying position of the winding station of FIG. 1.

FIG. 4 shows a plan view partially in section of a portion of the conveyor belt 9 with the supply bobbin 15 in the ready position and the supply bobbin 5 in the winding position. An empty yarn tube 17 standing on an individual tube support member 4 has just been removed from the winding position 6. The supply bobbin 5 is in the winding position 6. The yarn 21 drawn from the supply bobbin 5 can be seen in the balloon breaker 22, with the two mounting portions **22*a*,22*b* of the balloon breaker 22 forming an extension of the slit 62 in the yarn end receiving end portion 53. In operation, the yarn end 73 is passed through the slit 62 and between the mounting portions 22*a*,22*b* of the balloon breaker 22. The stop device 14 (not shown in detail) holds the supply bobbin in the winding position 6**.

Figure 7:
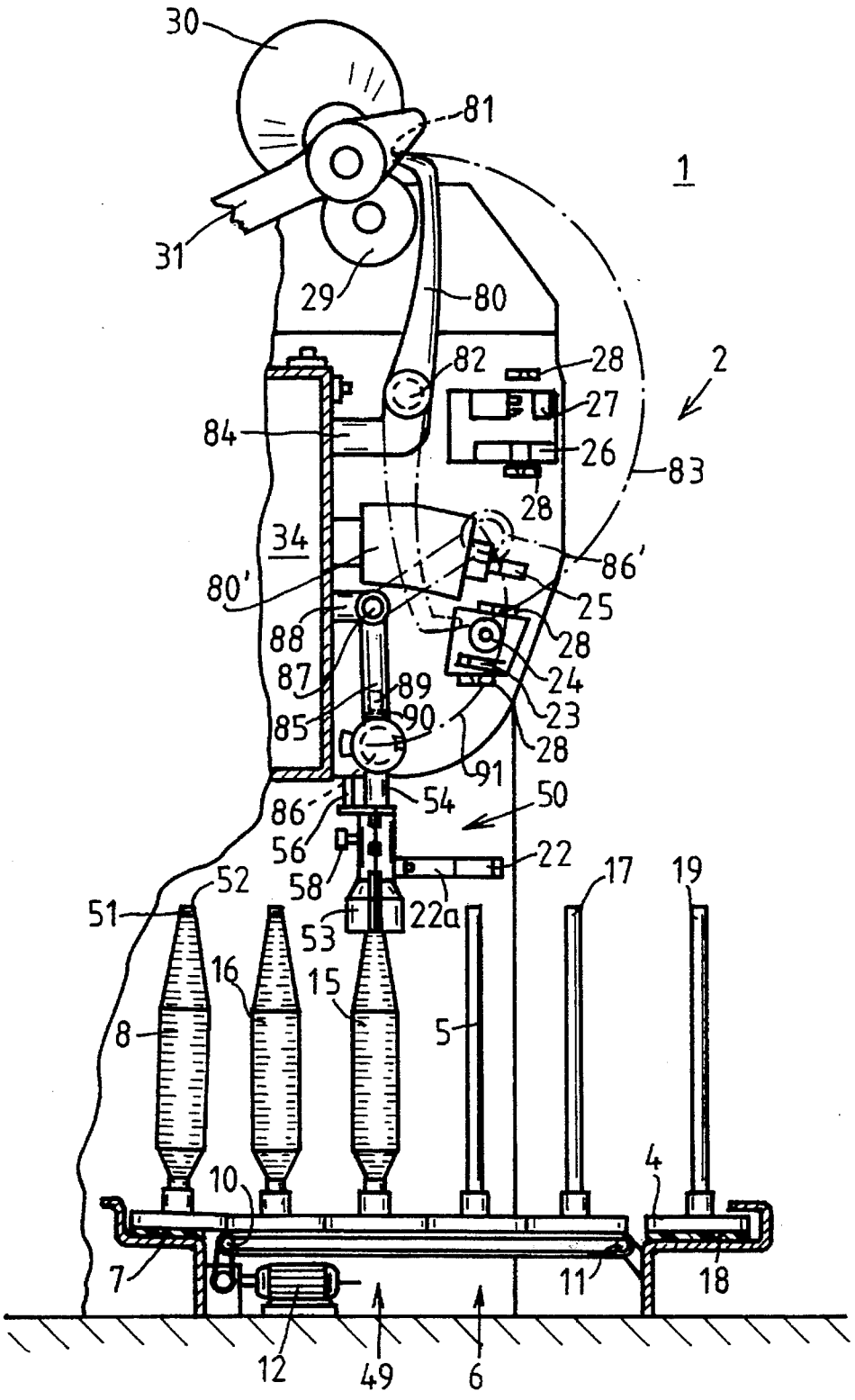
FIG. 7 is a view similar to FIG. 6 showing an alternate embodiment of the yarn end feeding components of the apparatus of the present invention.

An alternate embodiment of the present invention is shown in FIG. 7. Where the numeral items of FIG. 7 have been described above, the items in FIG. 7 are the same as the earlier descriptions and will not be again discussed. In contrast to the previously-described exemplary embodiment of the present invention, the alternate embodiment shown in FIG. 7 uses a separate suction tube 85 for locating and transferring the yarn end from the supply bobbin, and an additional suction tube 80 for locating and placing the yarn end from the take-up yarn package. In operation, once a supply bobbin has been completely unwound, the upper suction tube 80 is swiveled out of position of repose 80' into its yarn searching position in which the upper suction nozzle 81 is located in front of the surface of the take-up yarn package 30. The upper suction tube 80 can be swiveled about its joint 82, and the upper suction nozzle 81 travels along the arc 83. The joint 82 is located on the end of the connection tube 84 which joins the upper suction tube 80 to the suction conduit 34.

Before the yarn end from the take-up yarn package can be placed in the yarn joiner 25, the yarn end from the supply bobbin 15 in the ready position 49 must be first placed in the yarn joiner 25. To accomplish this task, a lower suction tube 85 is located so that the lower suction nozzle 86 faces the opening 55 of the tubular connection piece 54. The lower suction tube 85 is supported pivotably in the joint 87. The joint 87 is at the end of a connection tube 88 that joins the lower suction tube 85 to the suction conduit 34.

Once a supply bobbin located in the winding position 6 has been unwound, the yarn end finding device 50 operates as described earlier to find and secure the yarn end from the supply bobbin 15 in the ready position 49. The sensor 89 may be installed in the lower suction tube 85 in order to sense when a yarn end has been located and drawn into the lower suction tube 85. A baffle plate clamping device 90 is built into the lower suction tube 85 in order to clamp the yarn end and shut off the suction.

Once a yarn end has been clamped in the lower suction tube 85, the suction tube 85 pivots so that the lower suction nozzle 86 reaches the position 86', following an arc 91. In this position, the yarn end from the supply bobbin is placed in a yarn joiner 25. The suction tube 80, which holds the yarn end from the take-up package 30 then pivots back to its position 80', and in so doing, places the yarn end from the take-up package in the yarn joiner 25 as well.

A known yarn joining process then ensues, which may either be a splicing process or a knotting process. The lower suction tube 85 returns to its position of repose, in which the lower suction nozzle 86 faces the opening 55.

During the change of supply bobbins, in which the supply bobbin 15 in the ready position 49 advances to the winding position 6, the yarn end from the supply bobbin travels through the slit 62 and between the two mounting portions **22*a*,22*b* of the balloon breaker 22**.

The process by which a yarn end from a supply bobbin is transferred to an empty yarn take-up package to initiate winding of the take-up package is not described here because it is well-known in conventional devices, for example, DE 37 33 353 A1.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A method of feeding a yarn end from a bobbin to be taken up on a take-up yarn package at a winding position in a textile winder in which bobbins are advanced sequentially to the winding position in upright disposition on individual tube support members, comprising:

detecting the absence of yarn being unwound from a bobbin disposed at the winding position during an unwinding operation;

providing a device finding and feeding the yarn end;

finding a yarn end using said finding and feeding device on the bobbin next succeeding the bobbin disposed at the winding position, said finding occurring in response to said detecting; and feeding said found yarn end, using said finding and feeding device, for taking up at said winding position for unwinding the yarn from said next succeeding bobbin when said next succeeding bobbin has been advanced to the winding position.

2. The method according to claim 1 and characterized further in that the said finding of a yarn end comprises applying suction to the yarn on an upstanding end of said next succeeding bobbin.

3. The method according to claim 2 and characterized further in that said finding of a yarn end includes blowing air onto the yarn on the upstanding end of the next succeeding bobbin in order to loosen an end of said yarn.

4. The method according to claim 1 and characterized further in that said feeding of said found yarn end is performed during advance of said next succeeding bobbin to the winding position responsive to a determination that said bobbin disposed at the winding position has been emptied.

5. The method according to claim 1 and characterized further by sensing whether a yarn end has been found on said next succeeding bobbin; and in response to a sensing of no yarn end being found, advancing said next succeeding bobbin through said winding position without an unwinding operation being performed thereon.

6. The method according to claim 5 and characterized further in that said advancing of said next succeeding bobbin through the winding position is performed after a plurality of sensings of no yarn end being found have been performed on said next succeeding bobbin.

7. An apparatus for feeding a yarn end from a bobbin to be taken up on a take up yarn package at a winding position in a textile winder in which bobbins are advanced sequentially to the winding position in upright disposition on individual tube support members, comprising:

a detector for detecting the absence of yarn being unwound from a bobbin disposed at the winding position during an unwinding operation;

a yarn end finding device for finding a yarn end on the bobbin next succeeding the bobbin disposed at the winding position, said finding occurring in response to said detecting; and a yarn feeding device integral with said finding device for feeding said found yarn end for taking up at said winding position for unwinding the yarn from said next succeeding bobbin when said next succeeding bobbin has been advanced to the winding position.

8. The apparatus according to claim 7 and characterized further in that the said yarn end finding device comprises a suction tube for applying suction to the yarn on an upstanding end of the said next succeeding bobbin.

9. The apparatus according to claim 8 and characterized further in that said yarn end finding device includes an air blowing device for blowing air onto the yarn on the upstanding end to loosen an end of said yarn.

10. The apparatus according to claim 8 and further characterized in that said suction tube has a baffle plate clamping device therein for clamping a yarn end therein and cutting off suction in the tube therebeyond upon clamping of a yarn end.

11. The apparatus according to claim 7 and characterized further in that said yarn feeding device feeds said found yarn end during advance of said next succeeding bobbin to the winding position.

12. The apparatus according to claim 7 and characterized further by a sensing device for sensing whether a yarn end has been found on said next succeeding bobbin by said yarn end finding device, and, said next succeeding bobbin is advanced through said winding position without an unwinding operation being performed thereon in response to a sensing of no yarn end being found.

13. The apparatus according to claim 12 and characterized further in that the advancing of said next succeeding bobbin through said winding position is in response to a plurality of sensings of no yarn end being found by said sensing means.

14. The apparatus according to claim 7 and characterized further by the apparatus having a ready position at which the next succeeding bobbin is positioned for advance to the winding position and in that said yarn finding device includes a suction tube having an open yarn end receiving end portion adjacent the bobbin in the ready position.

15. The apparatus according to claim 14 and characterized further in that said suction tube has a movable portion for feeding said yarn end for taking up.

16. The apparatus according to claim 15 and characterized further in that said suction tube has a stationary portion that includes said open yarn and receiving end portion, said stationary portion having a vertical slit throughout its longitudinal extent to allow said yarn end to move therethrough out of the stationary portion upon movement of said movable portion.

17. The apparatus according to claim 16 and further characterized in that said movable portion is pivoted for rotation toward the winding position to feed the yarn end for taking up.

18. The apparatus according to claim 16 and further characterized by a balloon breaker disposed at said winding position and having a pair of mounting portions secured to said open yarn end receiving end portion on opposite sides of said slit for guiding a yarn end from the slit into the balloon breaker.

19. The apparatus according to claim 14 and further characterized in that said open yarn end receiving end straddles an upright end of the bobbin in the ready position to permit advance of the bobbin through the ready position.

20. The apparatus according to claim 14 and further characterized in that said open yarn end receiving end portion is adjustable to accommodate differing lengths of bobbins.

* * * * *